US006789469B1

(12) United States Patent
Tipton et al.

(10) Patent No.: US 6,789,469 B1
(45) Date of Patent: Sep. 14, 2004

(54) BUNDLING ASSEMBLY FOR STRAPPING MACHINE

(75) Inventors: Allison D. Tipton, Bloomingdale, IL (US); Richard G. Newman, Burlington, WI (US)

(73) Assignee: Illinois Tool Works, Inc., Glenview, IL (US)

( * ) Notice: Subject to any disclaimer, the term of this patent is extended or adjusted under 35 U.S.C. 154(b) by 2 days.

(21) Appl. No.: 10/425,579

(22) Filed: Apr. 29, 2003

(51) Int. Cl.[7] ..... B65B 13/18; B65G 35/06

(52) U.S. Cl. ..... 100/4; 100/7; 100/18; 100/26; 100/45; 198/726; 198/345.1; 53/589

(58) Field of Search ..... 100/4, 7, 8, 17, 100/18, 25, 26, 27, 49; 53/399, 589; 198/726, 345.1, 463.4

(56) References Cited

U.S. PATENT DOCUMENTS 4,015,722 A * 4/1977 Cooper et al. ..... 414/788.2
4,090,441 A * 5/1978 Muller ..... 100/7
4,312,266 A * 1/1982 Pasic ..... 100/7
5,560,180 A * 10/1996 Rodriguez et al. ..... 53/399
5,775,068 A * 7/1998 Strasser et al. ..... 53/550
5,944,477 A * 8/1999 Shill ..... 414/788

* cited by examiner

*Primary Examiner*—Allen Ostrager
*Assistant Examiner*—Jimmy Nguyen
(74) *Attorney, Agent, or Firm*—Mark W. Croll, Esq.; Donald J. Breh, Esq.; Welsh & Katz, Ltd.

(57) ABSTRACT

A bundling assembly for use with a strapping machine that is configured to position a strap material around a load and tension the strap material around the load includes first and second moving belts positioned at the strapping machine entrance in opposing relation to one another. The belts each have a paddle mounted thereto and define a pathway through the bundling assembly. A movable stop is positioned at the exit of the strapping machine and is movable between a stop position and a convey position. The moving belts rotate to contact the paddles with the load, urging the load into the entrance of the strapping machine and into an area under the chute. The belts stop rotation, thus stopping movement of the load upon contact of the load with the stop. The movable stop then moves to the convey position and the moving belts rotate such that the paddles move the load out of the exit of the strapping machine. A stabilizing assembly applies a slight pressure on the load during the strapping cycle.

9 Claims, 3 Drawing Sheets

BUNDLING ASSEMBLY FOR STRAPPING MACHINE

BACKGROUND OF THE INVENTION

The present invention is directed to strapping machines. More particularly, the present invention pertains to a bundling assembly for use with a strapping machine.

Strapping machines are in widespread use for applying a strap, such as a plastic strap, in a tensioned loop around a load. A typical strapping machine includes a strap chute for guiding the strap around the load, a strapping head through which the leading end of the strap is fed, and at which the strap is tensioned and sealed to itself, and a strap dispenser to dispense a desired length of strap from a strap material supply.

In one application, the strapping machine is used to strap bundles of printed materials. For example, in the printing industry, printed materials are often bundled and strapped prior to binding. These materials may also be bundled and strapped after binding and prior to handling for shipping.

Typically, the materials are stacked together to form a stack or log. The stack is then positioned in the strapping machine and a strap is positioned around the stack, tensioned, and sealed onto itself. The stack or log is formed in a stacker which is located upstream of the strapping machine.

As the materials are moved from the stacker to the strapping machine, the pages may fall out of alignment, or the stack may become skewed. This can create problems at the strapping machine, and may result in the damage to the printed materials.

In addition, in order to move the strapped materials (the load) from the strapper, some type of conveyance device must "reach into" the strapper to grasp the load, or "kick" the load out of the strapper. This can add time to the overall strapping operation, thus affecting the overall process time. In that the strapping operations are ancillary to the overall printing and binding operation, it is necessary to minimize the time required to carry out the bundling operation, rather than add time to carry out these functions.

Accordingly, there is a need for a bundling assembly that functions along with a strapping machine. Desirably, such a bundling assembly serves to maintain the lateral alignment of the stacked materials and moves the materials into the strapping machine. More desirably, such a machine longitudinally positions the load in the strapping machine and further moves the load out of the strapping machine to a downstream conveyor without any additional process time or handling steps or functions.

BRIEF SUMMARY OF THE INVENTION

A bundling assembly is configured for use with a strapping machine that positions a strap material around a load and tensions the strap material around the load. The bundling assembly serves to maintain the lateral alignment of the stacked materials (load) and moves the materials into the strapping machine. The bundling assembly longitudinally positions the load in the strapping machine and further moves the load out of the strapping machine to a downstream conveyor without any additional process time or handling steps or functions after the load is strapped.

The bundling assembly includes first and second moving belts positioned at the strapping machine entrance in opposing relation to one another. The belts each have a paddle mounted thereto and define a pathway through the bundling assembly.

A movable stop is positioned at the exit of the strapping machine and is movable between a stop position and a convey position. The moving belts rotate to contact the paddles with the load, urging the load into the entrance of the strapping machine and into an area under the chute. The belts stop rotation, thus stopping movement of the load upon contact of the load with the stop. The load is strapped and the movable stop moves to the convey position. The moving belts re-commence rotation, such that the paddles move the load out of the exit of the strapping machine.

In a present embodiment, the belts each include only one paddle, and a motor is associated with each of the belts. The motor are mounted to frames that enclose the belts.

The stop can include a rotating shaft and a stop element having a depending leg portion mounted to the shaft. The shaft rotates to move the leg between the stop position and the convey position. An actuator, such as a pneumatic cylinder is operably mounted to the shaft for rotating the shaft. Preferably, the stop position is adjustable to accommodate different sizes of materials.

The bundling assembly can also include a stabilizing assembly disposed between the moving belts and the movable stop. The stabilizing assembly is configured to stabilize the stack of materials during the strapping operation.

A present machine includes a controller. The moving belts, the movable stop and the stabilizing assembly are operably connected to the controller.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
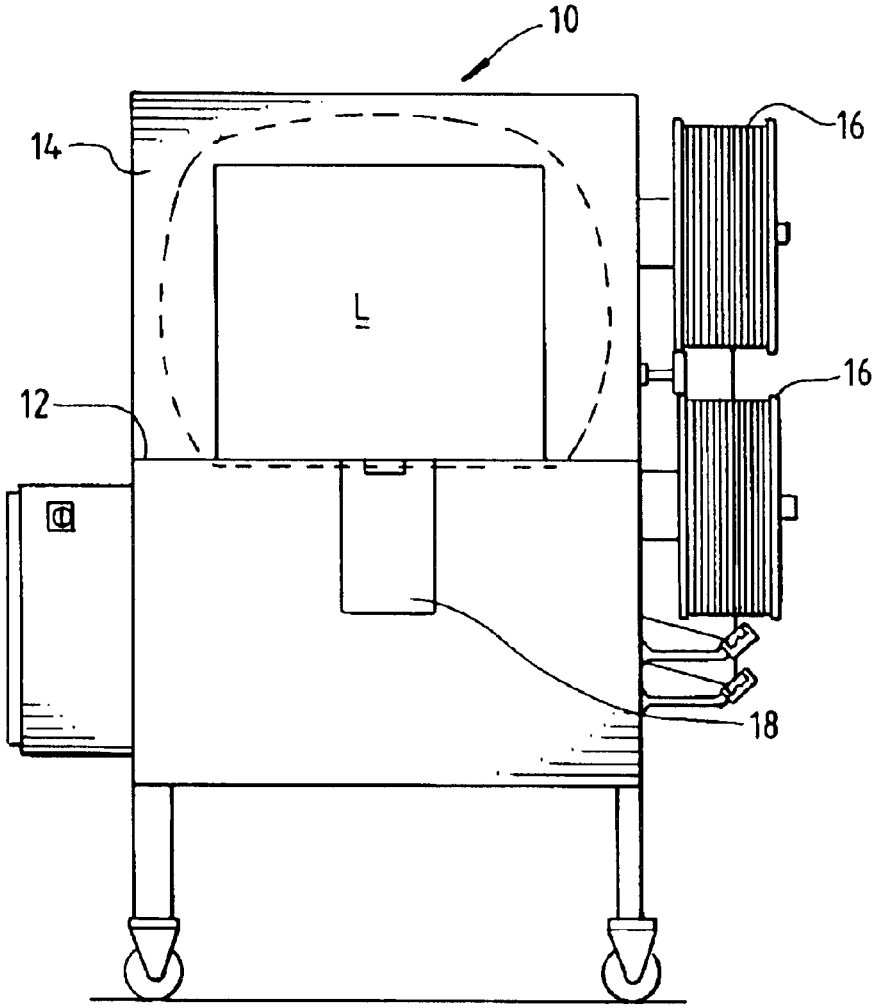
FIG. 1 is a front view of a conventional strapping machine.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the U.S. Patent Office, and does not imply, nor should be inferred to limit the subject matter disclosed herein.

Referring to the FIG. 1, there is shown a conventional strapping machine 10 having a workstation such as the illustrated tabletop 12 on which the load L may rest during the strapping operation. The machine 10 includes a chute 14 through which the strap S is advanced during the strapping operation and one or more strap dispensers 16 from which the strap S is dispensed to a strapping head 18. The strapping head 18 is that component of the machine 10 that withdraws or pulls the strap S from the dispenser 16, feeds the strap S through the chute 14, grasps the leading end of the strap S so as to bring it into contact with a trailing portion of strap, and tensions the trailing portion so as to compress the load L. The strap S is then sealed onto itself and severed to allow for removing the load L from the machine 10. The overall arrangement and operation of such a strapping machine 10 is disclosed in U.S. Pat. Nos. 4,605,456 and 5,299,407, which patents are commonly assigned with the present application and the disclosures of which are incorporated herein by reference.

Figure 4:
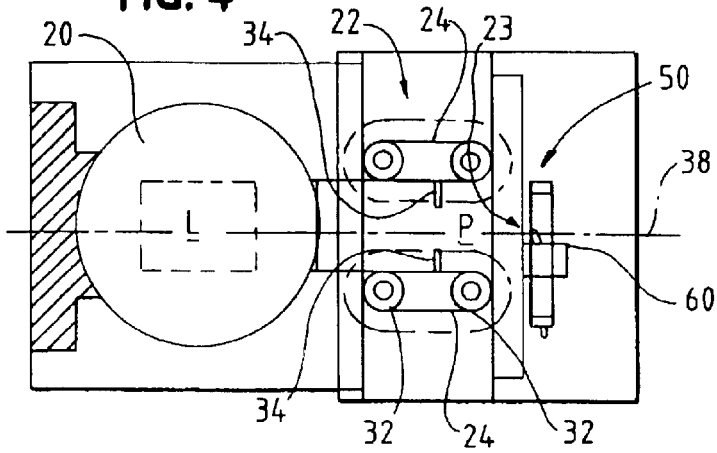
FIG. 4 is a top view of the machine of FIG. 2.

As in many high volume and/or high speed operations, the load or material L to be strapped is first oriented or prepared for strapping at an upstream process. For example, in the graphic arts industry (e.g., printing), the materials L may first be formed into a stack. The stack is then moved into the strapping machine 10 by automatic means. Referring briefly to FIG. 4, such a stacker is shown at 20, after which the stacked materials L are moved into the strapping machine 10.

As will be recognized by those skilled in the art, moving the materials L (particularly sheet-goods materials) can result in the materials L moving relative to one another such that the stack becomes slightly skewed. Such a skew can occur in both the lateral direction $d_t$ (that is, that direction that is transverse to the direction of movement $d_l$ into the strapping machine 10) as well as in the longitudinal direction $d_l$ (the direction parallel to the movement of the materials into the strapping machine 10).

Figure 2:
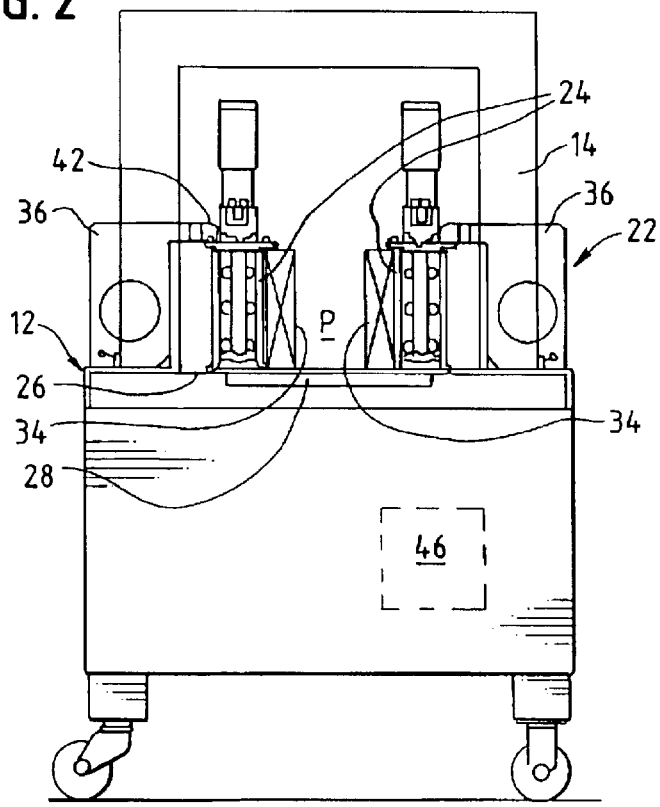
FIG. 2 is a front view of a strapping machine similar in overall design to that of FIG. 1, having a bundling assembly embodying the principles of the present invention.
Figure 3:
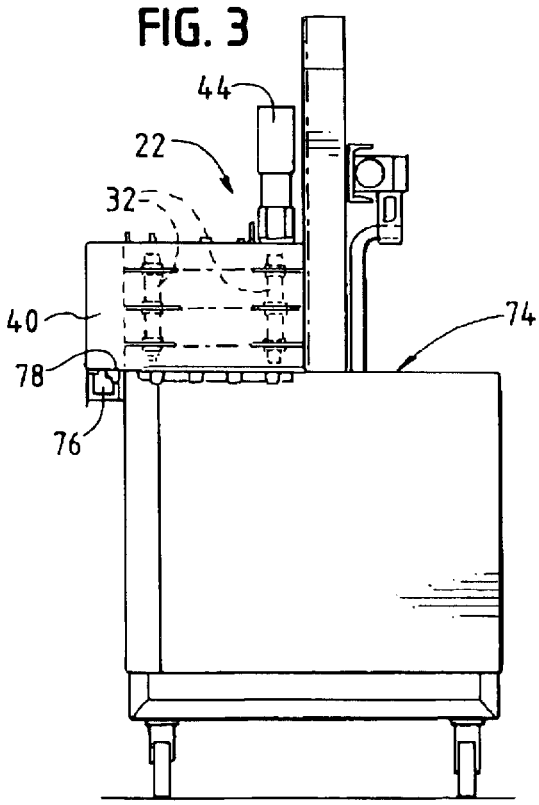
FIG. 3 is a side view of the machine of FIG. 2 illustrating the bundling assembly.

The present bundling assembly 22 overcomes the problems associated with skew and corrects this skew by maintaining alignment of the materials L and moving the materials L into the strapping machine 10 a predetermined distance. Referring to FIGS. 2 and 3, the bundling assembly 22 includes a pair of opposing belts 24 mounted at the strapping machine entrance 23, upstream of the strapping machine chute 14, and positioned on either side of the pathway P along which the materials L traverse to enter the strapper 10. A bottom surface 26 of the path P is defined generally by a plurality of rollers 28 or other friction reducing means to permit readily moving the materials L into the area 30 under the chute 14.

The belts 24 rotate around a plurality of rollers 32 to convey the material L toward the chute 14. Each belt 24 includes a paddle 34 that extends outwardly from the belt 24 and into the material pathway P. The paddles 34 are configured to contact the stacked material L and move the material L through the pathway P. As configured, the belts 24 are spaced from one another (on opposite sides of the pathway P), a distance $d_{24}$ about equal to the width w of the material L that is moved through the bundler 22. In this manner, as the paddles 34 move the material L along the pathway P, the belts 24 maintain the material L stacked in the transverse direction $d_t$ or orientation and the paddles 34 maintain the material L stacked in the longitudinal direction $d_l$ or orientation while moving the materials L through the bundling assembly 22.

In a present embodiment, the belts 34 are mounted within frames 36 that are movable toward and away from the pathway P centerline (the longitudinal centerline of the bundling machine as indicated at 38) to accommodate materials L of varying widths w. The frames 36 include enclosed side walls 40 and top walls 42 to enclose the belts 24 and to provide personnel protection.

Motors 44 are mounted to the frame top walls 42 to drive the belts 24. In a present configuration, the motors 44 include encoders (not shown) so that the position of the motor shaft can be continuously monitored. As such, the encoders, in combination with a control system 46 for the bundling assembly 22, permits controlling the alignment of the stack L (by assuring that the paddles 34 are maintained in opposing relation to one another) and controlling the depth to which the material stack L is moved into the strapping machine 10 (by controlling the distance of movement of the paddles 34 along the pathway P). Those skilled in the art will recognize that although the present motors 44 are described as using encoders, other means to precisely control or monitor the motor shaft position (and thus the position of the belts 24) can be used, such as stepper motors, servo-motors and the like, which other means are within the scope and spirit of the present invention.

Figure 5:
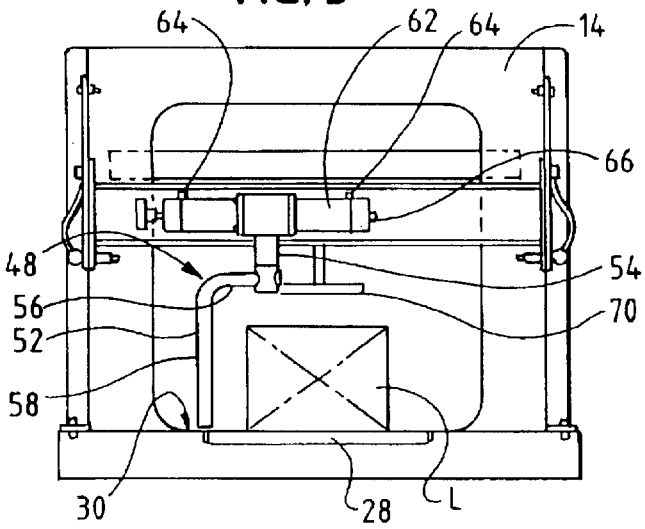
FIG. 5 is a rear view of the top portion of the machine showing the bundling assembly and having a stop bar rotated to the discharge position, and further showing the optional load stabilizer.
Figure 6:
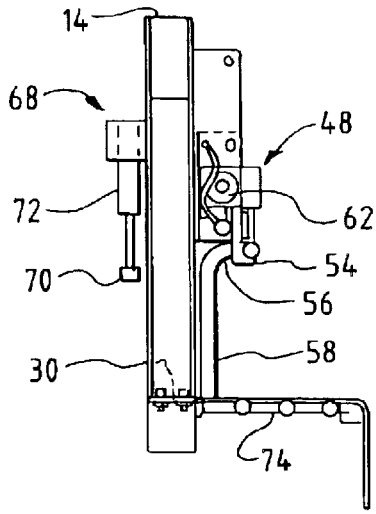
FIG. 6 is a side view of the bundling assembly of FIG. 5, illustrating the stop bar and load stabilizer.

Referring to FIGS. 4–6, to further control the depth or distance that the materials L are moved into the strapping machine 10, the bundling assembly 22 includes a movable stop 48 positioned at the exit 50 of the strapping machine 10. The stop 48 includes a portion that moves into the pathway P to provide a surface or element against which the materials L abut when moved into the area 30 under the chute 14 (the stop position), and which moves out of the pathway P (the convey position, which is illustrated in FIG. 5) to permit moving the materials L out from the area 30 under the chute 14.

In a present embodiment, the stop 48 is formed as a leg 52 mounted to a rotating shaft 54. The leg 52 has a transverse portion 56 (at which the leg 52 is mounted to the shaft 54) and a depending portion 58 that extends downwardly, toward the work surface 12. By rotating the shaft 54, the leg 52 moves in an arcuate path, indicated at 60 in FIG. 4, into and out of the pathway P (that is, between the stop position and the convey position). An actuator 62 is operably mounted to the shaft 54 for rotation. In a present embodiment, the actuator 62 is a pneumatic cylinder. Limit switches 64 can be mounted to the cylinder 62 to set the stop 48 at the stop and convey positions. An adjusting element 66 permits longitudinal adjustment of the stop bar 48 at the stop position to accommodate different sizes (lengths 1) of materials L.

Referring to FIGS. 5 and 6, optionally, the bundling assembly 22 can include a stabilizing assembly 68 to provide pressure on the materials L during the strapping operation. Presently, the stabilizing assembly 68 includes a bar 70 that is moved into contact with the top of the stacked materials L once positioned in the chute area 30. The bar 70 can be moved up and down (into contact with and away from the material L) by, for example, a pneumatic cylinder 72 that is controlled by the overall control system 46.

In operation, a stack of material L is moved into the pathway P and is positioned between the belts 24 with the paddles 34 at the trailing end T of the material L stack. The belt motors 44 are actuated and the paddles 34 urge the material L forward, into the area 30 under the strapping machine chute 14. The leading end E of the material stack L contacts the stop bar 48 and the belt motors 44 are stopped.

The belt motors 44 can be set to stop at this position by use of the motor 44 encoders. The optional stabilizer 68 can then move down to contact and stabilize the material L stack. The strapping machine 10 is then actuated to convey the strap S around the stack, tension and seal the strap onto itself. Contemporaneously with the strapping operation, the stop bar 48 is rotated out of the pathway P.

Once the strapping operation is completed, the belt motors 44 are again actuated. The belts 24 re-commence rotation and the paddles 34 then push or kick the now strapped material L stack out of the area 30 under the chute 14 onto a subsequent downstream conveyor 74.

In a present overall operation, it is anticipated that the materials can be strapped at a rate of about forty (40) bundles per minute. That is, about 40 bundled and strapped stacks can be formed per minute. To this end, the control system 46 for use with the bundling assembly 22 includes the necessary elements to monitor the position of the materials L as the materials L move into the machine 22, while the materials L are in the machine 22, and as the materials L are is moved out of the machine 22. For example, sensors 76 can be positioned at the entry to the pathway P (e.g., on a bottom panel 78 between the belts 24 and/or mounted to the belt frames 36), and limit switches 64 can be mounted to the stop bar cylinder 62 and stabilizer cylinder 72. Other sensors, as well as monitoring and control instrumentation will be appreciated by those skilled in the art.

In addition, although the present bundling assembly 22 is shown with one paddle 34 located on each belt 24, it is anticipated that multiple paddles (e.g., two paddles) can be disposed on each belt (equally peripherally spaced from one another (e.g., 180 degrees from one another), in a configuration in which the belts 34 are sufficiently long and define a sufficiently long pathway P.

All patents referred to herein, are hereby incorporated herein by reference, whether or not specifically done so within the text of this disclosure.

In the present disclosure, the words "a" or "an" arc to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A bundling assembly for use with a strapping machine that is configured to position a strap material around a load and tensions the strap material around the load, strapping machine having an entrance, a chute through which the strap material is conveyed and an exit, the bundling assembly comprising:

first and second moving belts positioned at the strapping machine entrance in opposing relation to one another, the belts each having a paddle mounted thereto, the moving belts defining a pathway through the bundling assembly;

a movable stop positioned at the exit of the strapping machine, the stop being movable between a stop position and a convey position, wherein the moving belts rotate to contact the paddles with the load to urge the load into the entrance of the strapping machine and into an area under the chute, the belts stopping rotation to stop movement of the load upon contact of the load with the stop, and wherein the movable stop moves to the convey position and the moving belts rotate, the paddles moving the load out of the exit of the strapping machine.

2. The bundling assembly in accordance with claim 1 wherein each belt includes only one paddle.

3. The bundling assembly in accordance with claim 1 including a motor associated with each of the belts.

4. The bundling assembly in accordance with claim 1 wherein the stop includes a rotating shaft and a stop element having a depending leg portion mounted to the shaft, and wherein the shaft rotates to move the leg portion between the stop position and the convey position.

5. The bundling assembly in accordance with claim 4 including an actuator operably mounted to the shaft for rotating the shaft.

6. The bundling assembly in accordance with claim 5 including an adjustment for adjusting the stop position.

7. The bundling assembly in accordance with claim 1 including a controller, wherein the moving belts and the movable stop are operably connected to the controller.

8. The bundling assembly in accordance with claim 1 including a between the moving belts and the movable stop.

9. The bundling assembly in accordance with claim 8 including a controller, wherein the moving belts, the movable stop and the stabilizing assembly are operably connected to the controller.

* * * * *

UNITED STATES PATENT AND TRADEMARK OFFICE

CERTIFICATE OF CORRECTION

PATENT NO. : 6,789,469 B1
DATED : September 14, 2004
INVENTOR(S) : Tipton et al.

It is certified that error appears in the above-identified patent and that said Letters Patent is hereby corrected as shown below:

Column 6,
Lines 43-44, should read
8. The bundling assembly in accordance with claim 1 including a stabilizing assembly disposed between the moving belts and the movable stop.

Signed and Sealed this

Twenty-sixth Day of April, 2005

JON W. DUDAS
*Director of the United States Patent and Trademark Office*